United States Patent [19]

Robb

[11] 4,424,907

[45] Jan. 10, 1984

[54] FISHING TACKLE STORAGE RACK

[76] Inventor: Barry L. Robb, 116 Ruby Red Ct., Longwood, Fla. 32750

[21] Appl. No.: 312,168

[22] Filed: Oct. 16, 1981

[51] Int. Cl.[3] ..... A47F 5/08; A47F 7/00

[52] U.S. Cl. ..... 211/60 R; 211/118; 211/170; 224/311; 224/922

[58] Field of Search ..... 211/60 R, 13, 60 SK, 211/116, 118, 89, 13, 86, 168, 68, 170, 64; 224/282, 309, 311, 324, 325, 922

[56] References Cited

U.S. PATENT DOCUMENTS

| | | | |
|---|---|---|---|
| 3,155,299 | 11/1964 | Horne et al. | 224/922 X |
| 3,376,614 | 4/1968 | Stahl | 224/311 X |
| 3,473,680 | 10/1969 | Downer | 224/311 X |
| 3,524,572 | 8/1970 | Hall | 224/922 X |
| 3,792,775 | 2/1974 | Riddle et al. | 211/60 R |

FOREIGN PATENT DOCUMENTS

| | | | |
|---|---|---|---|
| 77670 | 11/1950 | Norway | 211/116 |

*Primary Examiner*—Ramon S. Britts
*Assistant Examiner*—Robert W. Gibson, Jr.
*Attorney, Agent, or Firm*—Duckworth, Allen, Dyer & Pettis

[57] ABSTRACT

A fold-down storage rack for permitting the storage of fishing rods across a ceiling includes first and second rack supports, and a pair of parallel rods pivoted to one rack support and including a ridging end member between the rods. The second rack support is parallel to the first rack support and includes a holding bracket coupled thereto and movably engageable with the end member for holding the rack in a storage position substantially parallel with the ceiling, and disengageable to permit the storage rack to be pivoted away from the ceiling.

14 Claims, 3 Drawing Figures

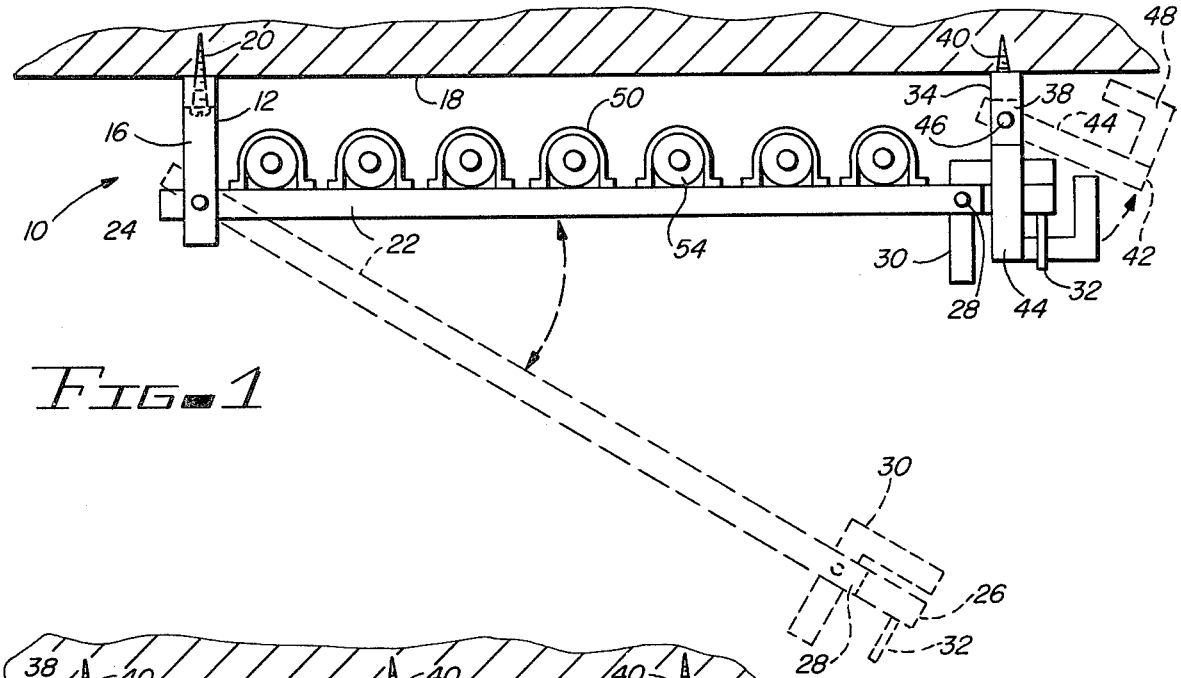
FIG. 1
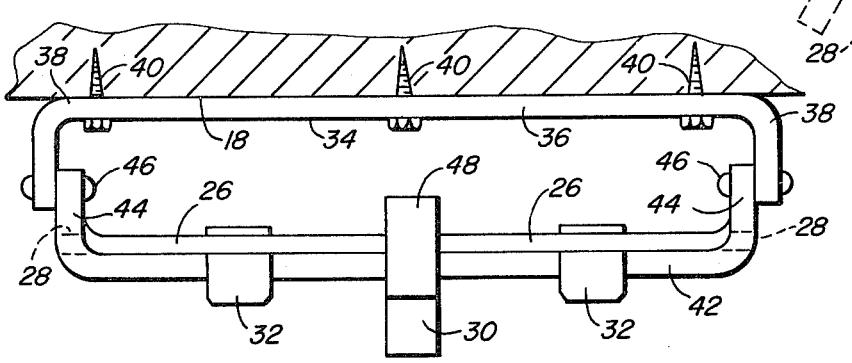
FIG. 3
FIG. 2
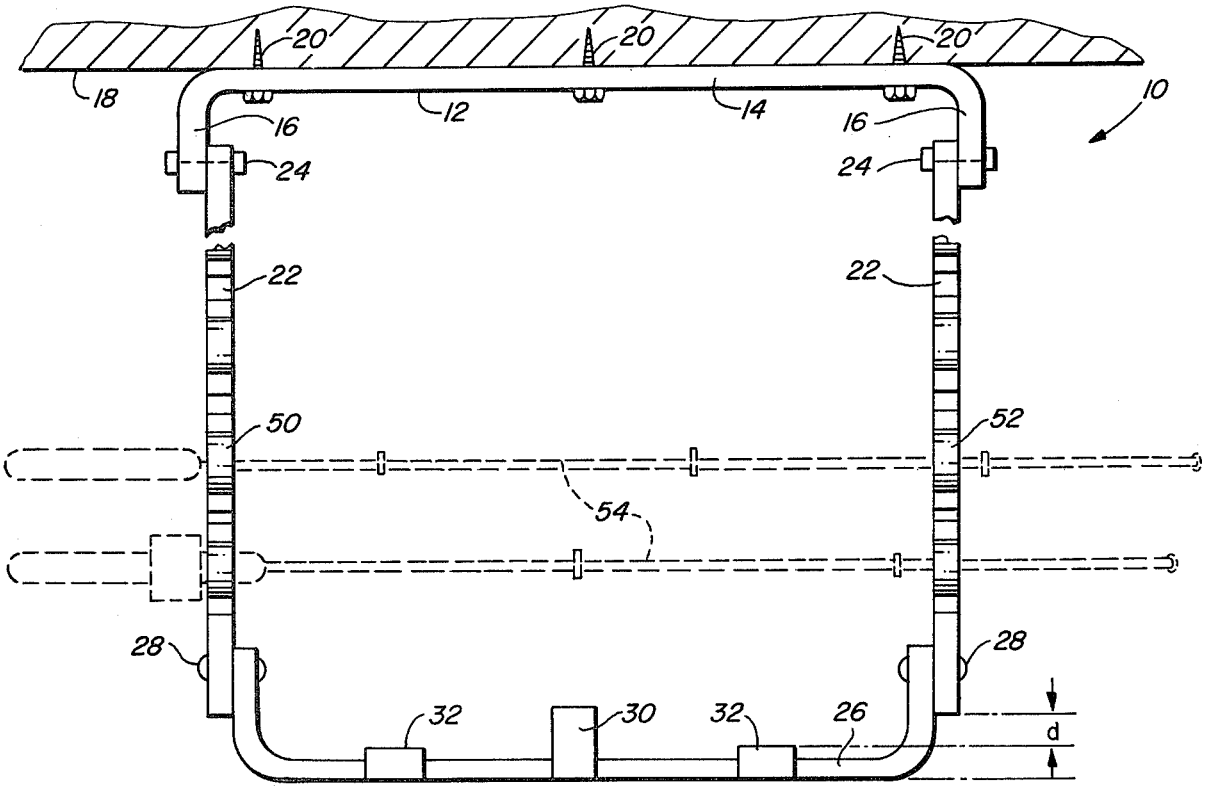

FISHING TACKLE STORAGE RACK

BACKGROUND OF THE INVENTION

1. Field of the Invention

The present invention relates generally to article supports and in particular relates to a rack specifically designed to support fishing tackle across the ceiling or any other supporting surface.

2. Description of the Prior Art

There are a variety of special purpose storage racks and supports designed in the prior art. Examples of such arrangements are disclosed in the following U.S. patent references: Lamb, U.S. Pat. No. 846,674; Hain, et al., U.S. Pat. No. 3,490,601; Riddle, et al., U.S. Pat. No. 3,672,513; Fowlkes, et al., U.S. Pat. No. 3,731,817; Riddle, et al., U.S. Pat. No. 3,792,775; Royeton, U.S. Pat. No. 3,794,182; Hazelhurst, U.S. Pat. No. 3,876,076; and Austin, et al., U.S. Pat. No. 3,995,742.

Despite the variety of such prior art arrangements, there remains a need for a facile storage rack for fishing tackle and similar articles which may be mounted parallel with a ceiling, and pivoted away from the ceiling for easy access to the article stored, and with means ensuring that the storage rack will not become inadvertently disengaged from the storage position.

SUMMARY OF THE INVENTION

The present invention contemplates a fold-down storage rack for permitting the storage of fishing rods and the like across a ceiling, the rack comprising a first rack support and means for mounting the first rack support against a flat surface such as a ceiling, with the bracket support extending substantially normal thereto. There is further provided a second rack support including at least one arm extending substantially normal away from the surface, with means for mounting the second rack support spaced from, and substantially parallel with the first rack support. A storage rack is pivoted at one end to the first rack support and dimensioned to extend across the space between the rack supports and the extremity of the arm of the second rack support. Holding means are coupled to the second rack support and movably engagable with the storage rack for holding the storage rack into a storage position substantially parallel with the surface, and disengagable to permit the storage rack to be pivoted away from the surface. Fastening means are provided along the storage rack to hold fishing rods or the like.

In the preferred embodiment of the present invention, each of the rack supports comprises a U-shaped bracket in which the arms of the bracket extend downwardly and normal to the ceiling surface. In the preferred embodiment, the support rack comprises a pair of parallel rods pivoted to the extremity of the first rack support, with an end member engaging the holding means bridging the two parallel rods. The extremities of the two rods serve as a rotation limiting means for a holding bracket coupled to the second rack support and constituting the holding means. Preferably, the end member includes a pair of locking tabs extending downwardly and overlapping the holding member when in the storage position.

BRIEF DESCRIPTION OF THE DRAWINGS

FIG. 1 is a side view of the storage rack in accordance with the present invention.

FIG. 2 is a portion of the storage rack of FIG. 1, with the rack pivoted away from the supporting surface.

FIG. 3 is an end view of a portion of the storage rack shown in FIG. 1.

DETAILED DESCRIPTION OF THE PREFERRED EMBODIMENT

A detailed description of the preferred embodiment will now be described with reference to FIGS. 1–3.

The storage rack of the present invention, referred to generally by the reference number 10, includes a first rack support 12 having a central portion 14 between two downwardly extending arms 16. As will be appreciated by those skilled in the art, the rack support 12 may comprise a single piece of extruded aluminum or similar material which has been bent in a U-shape to form the two arms 16 and the central remaining portion 14.

The rack support 12 is fixed to a ceiling 18 or other supporting surface by multiple fasteners 20.

The storage rack 10 is provided with a pair of parallel rods 22, each of which is coupled by a pivot 24 to the extremity of one arm 16 of the first rack support 12. As is illustrated in FIG. 2, each rod 22 is pivoted from the inside of the arm 16.

An end member 26, also forming a U-shape, is coupled between the outer extremity 28 of the two parallel rods 22. The end member 26 includes a downwardly extending handle 30, and a pair of locking tabs 32 formed of flat sheet metal brazed or otherwise fixed to the end member 26, the downwardly extending portion of each locking tab being spaced longitudinally with respect to the other extremity of each parallel rod 22 by a distance d, which distance d is equal to or greater than the cross sectional dimension of a holding member 42, described in greater detail below with reference to FIG. 3.

Noting FIG. 3, there is also provided a second rack support 34 having a central portion 36 and a pair of downwardly extending arms 38, the second rack support likewise forming a U-shaped member. The storage rack 10 is provided with a holding member 42 likewise formed of a U-shaped member having parallel arms 44 coupled by pivot 46 to the downwardly extending extremity of one arm 38 of the second rack support 34. The holding member 42 has a handle 48 centrally located thereon.

As shown in FIGS. 1 and 2, plural fasteners are provided along each parallel rod 22 for purposes of holding oblong objects such as fishing rods 54 or the like.

The manner of operation of the storage rack 10 of the present invention will now be described. Turning first to FIG. 2 and then FIG. 1, the storage rack is considered in the disengaged position which permits a rack to be pivoted around pivots 24 and downwardly away from the ceiling 18. Fishing poles 54 or the like may be added to or removed from the storage rack 10. In order to relocate the storage rack in the storage position, end member 26 and parallel rods 22 are rotated up toward the ceiling 18 and about the pivot 24.

Now noting FIG. 1, the holding member 42 is rotated around pivot 46 out of the path of the end member 26, permitting the parallel rods 22 and the associated end member 26 to be rotated upward through the second rack support 34. With the end member 26 pushed closer toward the ceiling 18 than the extremity of the arm 16, the holding member 42 is rotated downward under the end member 26 and between the extremity 28 of each parallel rod 22, and the locking tabs 32 (Note FIG. 1).

Thereafter, the storage rack will be held secure in a storage position until such time as the parallel rod and end member combination is pushed upward toward the ceiling, again permitting the holding member 42 to be disengaged, thereafter permitting the storage rack to be rotated downward.

While the various dimensions associated with the storage rack are not critical, it will be understood that in accordance with the present invention, it is necessary to dimension the end member 26 in order that it will come into engagement with the holding member 42.

I claim:

1. A fold-down storage rack for permitting the storage of fishing rods and the like across the ceiling, said rack comprising:

a first rack support;

means for mounting said rack support against a flat surface such as a ceiling, with said rack support extending substantially normal thereto;

a second rack support including at least one arm;

means for mounting said second rack support against said surface along a line spaced from and substantially parallel with said first rack support with said arm extending away from said surface;

a storage rack pivoted at one end to said first rack support and dimensioned to extend across the space between said rack supports and adjacent the extremity of said arm of said second rack support;

holding means coupled to said second rack support and movably engagable with said storage rack for holding said storage rack into a storage position substantially parallel with said surface, and disengagable to permit said storage rack to be pivoted away from said surface, said holding means comprising a holding bracket having a pair of arms, each bracket arm pivoted to said second rack support; and fastening means along said storage rack for holding fishing rods or the like.

2. The fold-down storage rack recited in claim 1 wherein said storage rack is dimensioned to extend between the extremities of said two arms of said holding bracket, whereby said holding bracket may be rotated under said storage rack for holding said rack in said storage position substantially parallel with said surface.

3. The fold-down storage rack recited in claim 2 further comprising means on said holding bracket for locking said storage rack and said holding bracket in said storage position.

4. The fold-down storage rack recited in claim 2 further comprising means along the periphery of said storage rack for limiting the pivotal rotation of said holding bracket toward said first rack support.

5. The fold-down storage rack recited in claim 2 wherein said first rack support comprises a single length of material bent to form two arms at the opposite ends thereof which are substantially normal to the central remainder of said length.

6. The fold-down storage rack recited in claim 5 wherein said means for mounting said first rack support against said flat surface comprises a fastener extending through a central remainder of said length, with said two arms of said rack support extending substantially normal from said surface.

7. The fold-down storage rack recited in claim 5 wherein said second rack support comprises a single length of material bent to form two arms at the opposite ends thereof, which are substantially normal to the central remainder of said length.

8. The fold-down storage rack recited in claim 7 wherein said means for mounting said second rack support against said flat surface comprises a fastener extending through the central remainder of said length, with said two arms of said rack support extending substantially normal from said surface.

9. The fold-down storage rack recited in claim 7 wherein said storage rack comprises:

a pair of substantially parallel rods, each rod pivoted to the extremity of one of said arms of said first rack support;

an end member between said pair of rods; and wherein said fastening means extend along said rods.

10. A fold-down storage rack as recited in claim 9 wherein said holding means comprises:

a single length of material bent at each end to form a pair of holding arms extending substantially normal to the central remainder of said length with each holding arm pivoted to an arm of said second rack support; and wherein said length of material forming said holding means is dimensioned to pivot into engagement with said end member when said storage rack is in the storage position.

11. The fold-down storage rack recited in claim 10 wherein said parallel rods are spaced apart a distance equal to the distance between said two arms and said holding bracket, whereby rotation of said holding bracket arms is limited by the extremity of said rods.

12. A fold-down storage rack for permitting the storage of fishing rods and the like across the ceiling, said rack comprising:

a U-shaped rod support attached to said surface and having a pair of outwardly extending arms;

a pair of rods, each pivoted to one of said arms of said rod support;

an end member between said rods at the inner extremity thereof;

a U-shaped end member support attached to said surface and spaced from said rod support and including two outwardly extending arms;

a holding bracket pivotably coupled between said two arms of said end member support for engaging said end member to hold said rods substantially parallel with said surface in a storage position;

means along said rods for holding fishing tackle or the like; and wherein said rods are dimensioned to limit rotation of said holding bracket toward said rod support.

13. The fold-down storage rack recited in claim 12 further comprising means on said end member for locking said holding bracket into engagement therewith.

14. The fold-down storage rack recited in claim 13 wherein said locking means comprises a locking tab extending longitudinally a distance from the extremity of said rods which is greater than the cross sectional dimension of said holding bracket, whereby said holding bracket may be fitted between said locking tab and the extremity of said pair of rods.

* * * * *